US009659474B1

(12) United States Patent
Kashyap et al.

(10) Patent No.: US 9,659,474 B1
(45) Date of Patent: May 23, 2017

(54) AUTOMATICALLY LEARNING SIGNAL STRENGTHS AT PLACES OF INTEREST FOR WIRELESS SIGNAL STRENGTH BASED PHYSICAL INTRUDER DETECTION

(71) Applicant: Symantec Corporation, Mountain View, CA (US)

(72) Inventors: Anand Kashyap, Mountain View, CA (US); Yongjie Cai, Mountain View, CA (US); Qiyan Wang, Mountain View, CA (US)

(73) Assignee: Symantec Corporation, Mountain View, CA (US)

( * ) Notice: Subject to any disclaimer, the term of this patent is extended or adjusted under 35 U.S.C. 154(b) by 127 days.

(21) Appl. No.: 14/585,733

(22) Filed: Dec. 30, 2014

(51) Int. Cl.
*G08B 13/18* (2006.01)
*G08B 13/24* (2006.01)

(52) U.S. Cl.
CPC ..... *G08B 13/2491* (2013.01)

(58) Field of Classification Search
None
See application file for complete search history.

(56) References Cited

U.S. PATENT DOCUMENTS

2002/0127967 A1* 9/2002 Najafi ..... G01S 5/0027 455/3.05
2003/0112139 A1* 6/2003 Matsui ..... G01V 8/10 340/500
2008/0270172 A1* 10/2008 Luff ..... G06Q 30/02 705/1.1
2009/0268030 A1* 10/2009 Markham ..... G01S 3/54 348/158
2013/0143600 A1* 6/2013 Jan ..... H04W 64/006 455/456.3
2015/0334569 A1* 11/2015 Rangarajan ..... H04W 64/003 726/4
2015/0371139 A1* 12/2015 Kamlani ..... H04W 4/023 706/12

* cited by examiner

*Primary Examiner* — Nabil Syed
*Assistant Examiner* — Kevin Lau
(74) *Attorney, Agent, or Firm* — Womble Carlyle Sandridge & Rice LLP

(57) ABSTRACT

A method for intruder detection is provided. The method includes determining received signal strength of a first wireless device, while the first wireless device is moved at random within a region and generating a profile of the received signal strength of the first wireless device. The method includes determining received signal strength of a second wireless device and issuing an alert, responsive to received signal strength of the second wireless device meeting the profile. An intruder detection system is also provided.

18 Claims, 6 Drawing Sheets

AUTOMATICALLY LEARNING SIGNAL STRENGTHS AT PLACES OF INTEREST FOR WIRELESS SIGNAL STRENGTH BASED PHYSICAL INTRUDER DETECTION

BACKGROUND

Intruder detection systems often require installation of specialized equipment and wiring, including various sensors and power supplies. Sensors for intruder detection systems generally fall in two major categories. A first category is hardwired sensors, such as window switches, door switches and floor pads. A second category is area-based noncontact sensors, such as ultrasound transceivers and infrared detectors. Each category of sensors has advantages and disadvantages. The installation process for an intruder detection system may be expensive to a user and disruptive to the home or business environment. Further, professional burglars may be able to defeat known, familiar sensor and wiring installations.

It is within this context that the embodiments arise.

SUMMARY

In some embodiments, a method for intruder detection is provided. The method includes determining received signal strength of a first wireless device, while the first wireless device is moved at random within a region and generating a profile of the received signal strength of the first wireless device. The method includes determining received signal strength of a second wireless device and issuing an alert, responsive to received signal strength of the second wireless device meeting the profile, wherein a processor performs at least one action of the method.

In some embodiments, a tangible, non-transitory, computer-readable media having instructions thereupon which, when executed by a processor, cause the processor to perform a method is provided. The method includes analyzing received signal strength of a first wireless device, as observed by a wireless sniffer during random motion of the first wireless device within a region and determining a profile of the received signal strength of the first wireless device, based on the analyzing. The method includes determining whether received signal strength of a second wireless device, as observed by the wireless sniffer, matches the profile and indicating an intruder detection, based at least in part on a determination that the received signal strength of the second wireless device matches the profile.

In some embodiments, an intruder detection system is provided. The intruder detection system includes a wireless sniffer, configured to detect wireless devices and determine received signal strength. The system includes a memory configured to store a profile and an alert module configured to issue an alert in response to being triggered. The system includes an analytics module configured to generate the profile based on analysis of received signal strength of a first wireless device moved at random within a region in which the wireless sniffer is located, and configured to perform comparison of received signal strength of a second wireless device to the profile and trigger the alert module based at least in part on the comparison.

Other aspects and advantages of the embodiments will become apparent from the following detailed description taken in conjunction with the accompanying drawings which illustrate, by way of example, the principles of the described embodiments.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

An intruder detection system and related method are herein described. The intruder detection system makes use of a wireless router with a sniffer, or a standalone wireless sniffer in various embodiments, specially configured to analyze received signal strength (RSS) and media access control (MAC) addresses of wireless devices in the vicinity of the sniffer. The system develops and maintains a profile of received signal strength, and a whitelist, or some other suitable list, of the media access control addresses of one or more accepted wireless devices. When a wireless device, with a media access control address, is detected, the system looks to see if the media access control address is present on the whitelist and looks to see if the received signal strength indicates the wireless device is within the same building or defined locale as the sniffer, in accordance with the profile. If the wireless device is within range according to the profile, e.g., the received signal strength is greater than a threshold defined in the profile or matches a stable value in the profile, and the media access control address is not present on the white list, a notification or alert is generated. In this manner, the system can detect an intruder carrying a wireless device inside of the same building as the sniffer, and determine that the wireless device has an unknown (i.e., not present on the whitelist) media access control address, in which case this is likely an intrusion event. Updates to the whitelist are performed under certain circumstances, such as upon the occurrence of a false alarm, or contemporaneous detection of a not yet whitelisted wireless device and a whitelisted wireless device, etc. The embodiments avoid systematic training or the user manually conducting measurements prior to being able to detect intruders. As described in more detail below the radio signal strengths are automatically learned based on the routine movement of a user upon initialization of the system. Threshold parameters are then determined based upon the learning so that an intruder can be detected.

Figure 1:
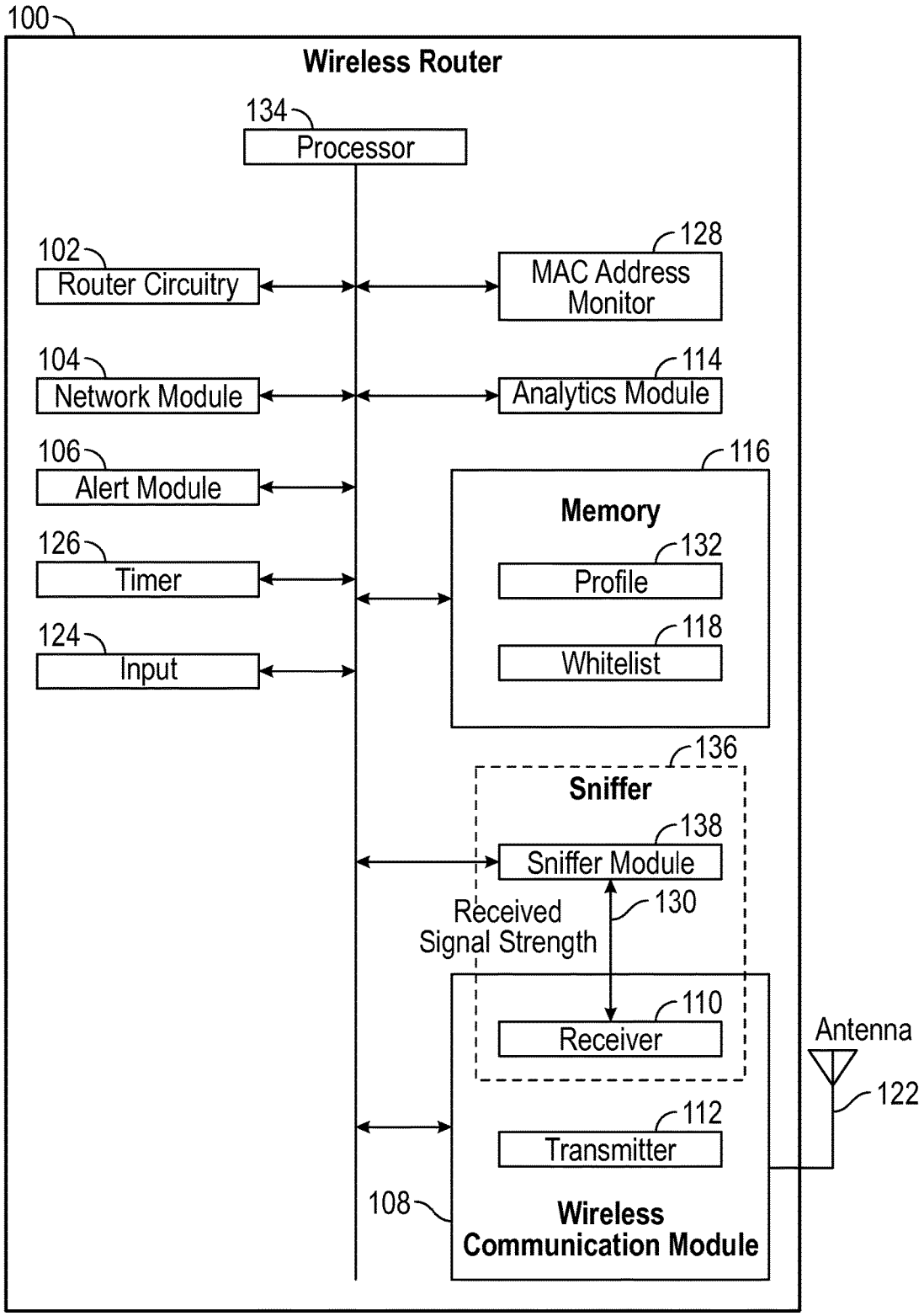
FIG. 1 is a system diagram of a wireless router configured for intruder detection, in accordance with some embodiments.

FIG. 1 is a system diagram of a wireless router 100 configured for intruder detection, in accordance with an embodiment of the present disclosure. Embodiments of the wireless router 100 can be created by adding programming and/or specialized components to a standard wireless router, as used in a home or business to wirelessly route a coupling to a network 120 in some embodiments. The embodiments for the wireless router can be created by implementing a wireless router with specialized programming and/or components. In further embodiments, special-purpose programming and/or components can be added to a computer coupled to a wireless router 100, for example to implement portions of the sniffer 136. In still further embodiments, the sniffer 136 can be implemented as a standalone device, with specialized programming and/or components, and without necessarily including the transmitter 112, the router circuitry 102 or other components used in a standard wireless router 100 but not necessary for a sniffer 136. Alternatively, the sniffer 136 could be implemented as a standalone device coupled to a computer, with some of the software on the computer. Further variations of the above embodiments are readily devised as FIG. 1 is illustrative and not meant to be limiting.

In one embodiment as shown in FIG. 1, the wireless router 100 includes router circuitry 102, a network module 104, an alert module 106, a wireless communication module 108, an analytics module 114, a memory 116, a media access control address monitor 128, and a processor 134, which can communicate with the various components using a bus or other connection. The processor 134 performs some or all of the functions of various modules, which can be implemented in software, hardware, firmware, or combinations thereof. The network module 104 of the wireless router 100 couples to a network, such as a local area network (LAN) or a global communication network such as the Internet, through well-established and understood mechanisms. Router circuitry 102 of the wireless router 100 manages the network module 104 and the wireless communication module 108. Among other tasks, the router circuitry 102, the network module 104, and the wireless communication module 108 handle the wireless routing of data to and from any wireless devices that couple to the wireless router 100, similarly to commercially available wireless routers. The wireless communication module 108 includes a receiver 110 and a transmitter 112, or a transceiver, etc. The receiver 110 and transmitter 112 are coupled to an antenna 122, which is used to wirelessly transmit and receive data. The media access control address monitor 128 monitors media access control addresses of wireless devices, as obtained via the wireless communication module 108 and the antenna 122.

A sniffer 136 is implemented using the receiver 110 of the wireless communication module 108, and a sniffer module 138 which is able to discover or detect a received signal strength 130 from the receiver 110. In various embodiments, the sniffer module 138 could be implemented in a wireless router 100, in a stand-alone sniffer, or in a computing device coupled to the receiver 110 of a wireless router 100, or in combinations of the above. In some embodiments, sniffer 136 may be implemented as a stand-alone module external or separate from wireless router 100. In the embodiment shown in FIG. 1, the receiver 110 amplifies signals from wireless devices, as received via the antenna 122, and determines the received signal strength 130. The received signal strength 130 could be in the form of an analog signal, such as a variable voltage expressed on a signal line, or a digital signal, such as a digitized parameter value sent on a bus or other communication path. Received signal strength 130 is a parameter or signal commonly available in other wireless sniffers, and is determined herein in a manner well known in the art. For example, the industry standard RSSI (received signal strength indicator) or the industry standard RCPI (received channel power indicator), or other indication of signal strength could be used, or another signal, data, or device could be applied.

Still referring to FIG. 1, a media access control address, from the media access control address monitor 128, is evaluated or analyzed by the analytics module 114. In a learn mode or training mode, the analytics module 114 takes media access control addresses from the media access control address monitor 128, and puts these into the whitelist 118, which is maintained in the memory 116. For example, a user could place the wireless router 100 into learn mode or training mode, and the analytics module 114 then places media access control addresses of any wireless devices, which have media access control addresses and are within a detection zone of the wireless router 100, into the whitelist 118. In an intruder detection mode, the analytics module 114 takes media access control addresses from the media access control address monitor 128, and determines whether or not these media access control addresses are in the whitelist 118. For example, a user could place the wireless router 100 into intruder detection mode, and the analytics module 114 then compares media access control addresses of any wireless devices, which have media access control addresses and are within a detection zone of the wireless router 100, to the whitelist 118. In intruder detection mode, any such media access control address from a detected wireless device that is not found on the whitelist 118 results in the analytics module 114 triggering the alert module 106.

Continuing with FIG. 1, a further function of the analytics module 114 is to cooperate with the sniffer module 138 to analyze the received signal strength 130. Based on analysis of the received signal strength 130, the analytics module 114 produces a profile 132, which is stored in the memory 116. In the embodiment shown, the profile 132 represents the received signal strength 130 of a wireless device that is inside the same building or some defined region as the sniffer 136. A scenario depicting how the profile 132 is described in more detail with regard to FIGS. 2A and 2B. Portions or all of the analytics module 114 of FIG. 1 could be implemented as software executing on the processor 134, which could be a processor that is further used in other aspects of the wireless router 100, i.e., a processor in or coupled to the wireless router 100, or could be a processor dedicated to the analytics functions. Specifically, portions of the analytics module 114 could be implemented in hardware, firmware, software, or combinations thereof. It should be appreciated that a processor 134 may refer to a programmable logic device or a microprocessor in some embodiments. When the analytics module 114 detects an intruder, as discussed above and further described below with reference to FIGS. 2A-2C, the analytics module triggers the alert module 106 of the wireless router 100. The alert module 106 then issues a notification or alert. The notification could be in the form of visual notification, such as lighting a lamp, an audible notification, such as issuing an alarm sound, or sending a message or other notification via the network module 104 to the network 120, e.g., to a server, a computing device, a cell phone, a destination device or agency, among other options, as will be further discussed with reference to FIG. 3.

Some embodiments of the wireless router 100 of FIG. 1 can have one or more input devices 124, such as buttons, switches, a touchscreen, an input port, and so on. An input device 124, in such embodiments, can be used to activate learn mode, deactivate learn mode, activate intruder detection mode, deactivate intruder detection mode, initiate a delayed activation of intruder detection mode, indicate a false alarm, and/or perform, initiate or terminate other functions in response to a user request. Some embodiments of the wireless router 100 have a timer 126. The timer 126 is applied to timing intervals while monitoring media access control addresses. The timer could thus be applied during a training or learning mode, in order to gauge time lengths of device presences and apply these to the whitelist 118. For example, if a wireless device is present for less than a specified time, the media access control address would not be added to the whitelist 118. The timer 126 could be applied during intruder detection mode, in order to gauge a time length of a presence of a wireless device, for determination of whether to trigger the alert module 106. For example, the timer could be used to establish a minimum time for an intruder positive detection signal. Detection of a wireless device for less than this minimum time would not trigger an alert. Alternatively, the timer 126 could be applied to starting and stopping, e.g., scheduling, the intruder detection mode, or any of the other modes.

Figure 2A:
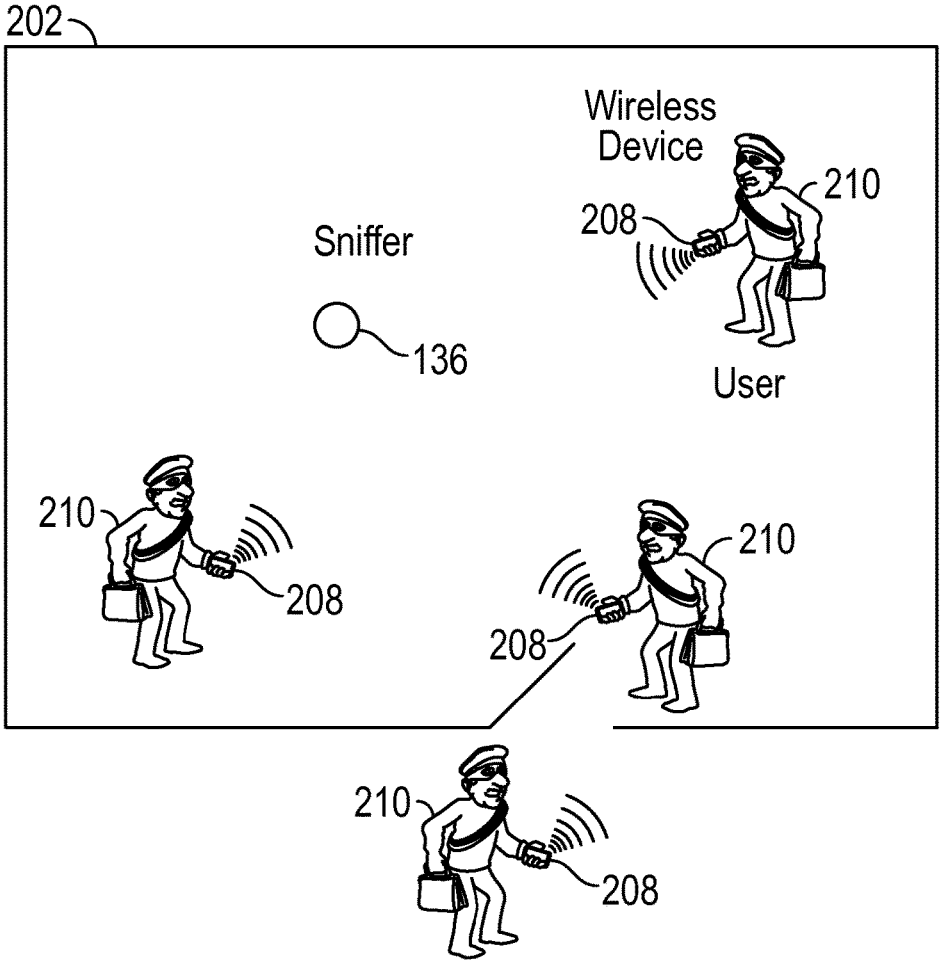
FIG. 2A is a scenario diagram, showing the sniffer of the wireless router of FIG. 1 learning signal strengths of a wireless device in a house or business in accordance with some embodiments.

FIG. 2A is a scenario diagram, showing the sniffer 136 of the wireless router 100 of FIG. 1 learning signal strengths of a wireless device 208 in a house or business in accordance with some embodiments. The sniffer 136 is located in a building 202, such as a house or business to be protected from intrusion. For example, the sniffer 136 could be a standalone device, a device coupled to a computer, or could be part of a wireless router 100 used for wireless coupling to various computing devices in the home or business, in various embodiments. The user 210 has the wireless device 208, e.g., a smart phone with Wi-Fi (wireless fidelity) capability and walks from outside the building 202 into the building 202, and performs random motions or activities inside the building 202. Smart phones and other wireless devices 208 with ability to couple to a wireless network such as administered by the wireless router 100 are widely available. It is not necessary for the user 210 to perform a systematic training regimen with the wireless device 208, involving specific locations for the wireless device 208 inside the building 202. The user 210 can simply go about regular activities, with no specific plan or locations in mind, and the system learns about the received signal strength 130 of the wireless device 208.

Figure 2B:
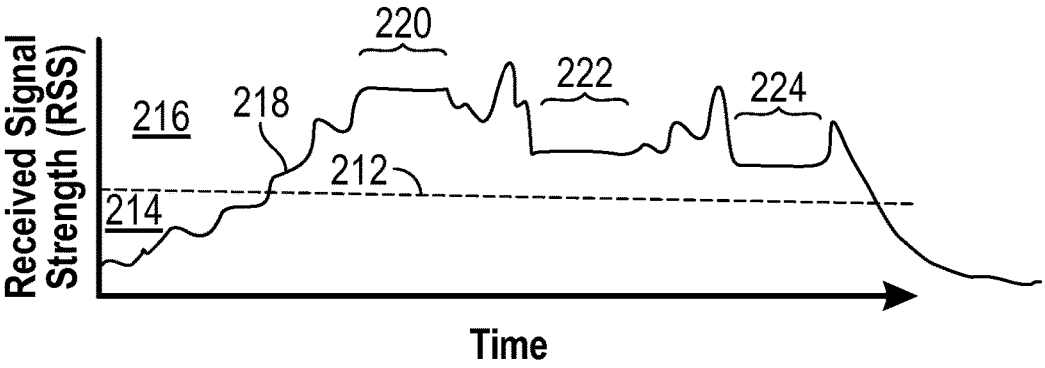
FIG. 2B is a plot of received signal strength of a wireless device over time, as could be determined using the sniffer of the wireless router of FIG. 1 in the scenario of FIG. 2A.

FIG. 2B is an example plot 218 of received signal strength 130 of a wireless device 208 over time, as could be determined using the sniffer 136 of the wireless router 100 of FIG. 1 in the scenario of FIG. 2A. Ideally, received signal strength 130 would follow a power law with respect to signal strength versus distance, but in reality there are many factors that can vary the received signal strength 130 from this, such as reflections, absorption, multiple paths, etc. Generally, when the wireless device 208 is outside the building 202 (see FIG. 2A) or some other set boundaries, the received signal strength 130 is in a lower region 214 of the plot 218, and when the wireless device 208 is inside the building 202 or some other set boundaries, the received signal strength 130 is in a higher region 216 of the plot 218. The lower region 214 and the higher region 216 are separated by a threshold 212, which can remain hypothetical or be actually determined or approximated by some embodiments of the analytics module 114. When the user 210 with the wireless device 208 is relatively stationary for a period of time, for example sitting at a table, sitting in a chair or sofa, resting, sleeping, cooking in the kitchen, etc., the received signal strength is likely to be at a stable value for a period of time 220, 222, 224. For example a first period of time 220 in the plot 218 could represent a time when the user 210 with the wireless device 208 is stationary and relatively closer to the sniffer 136, so that the stable value of the received signal strength 130 is relatively high. A second period of time 222 in the plot 218 could represent a time when the user 210 with the wireless device 208 is stationary at an intermediate distance from the sniffer 136, but still inside the building 202. And, a third period of time 224 in the plot 218 could represent a time when the user 210 with the wireless device 208 is stationary and relatively farther away from the sniffer 136, but still inside the building 202, so that the stable value of the received signal strength 130 is relatively low.

Referring to FIGS. 1, 2A and 2B, from these stable values of the received signal strength 130, the analytics module 114 could determine a maximum stable received signal strength value and a minimum stable received signal strength value which represent the wireless device 208 being inside the building 202 or some other predefined boundaries. For example, the analytics module 114 could look for the received signal strength 130 being stable to within a predetermined variability for a predetermined time span, and record such values or at least a minimum and maximum value, in the profile 132. The analytics module 114 could also look for local minima and local maxima in values of the received signal strength 130, ranges of the received signal strength 130 and other characteristics as shown in the plot 218. Generally, once outside the building 202, the user 210 should not linger, or should indicate to the system only when the user 210 is inside the building 202, e.g., by invoking a learn mode using an input device 124 or other communication to the analytics module 114. Failing to do so might cause the system to see a stable value on the received signal strength 130 while the user 210 and the wireless device 208 are outside the building 202, which could be added erroneously to the profile 132 as indicating the wireless device 208 is inside the building 202. In some embodiments, the user 210 could invoke learn mode and indicate that the user will be moving at random outside of the building 202, so that the system can learn values of received signal strength 130 associated with the wireless device 208 being outside of the building 202. The analytics module 114 can then modify the profile 132 so that the profile includes or represents values of the received signal strength 130 associated with the wireless device 208 being inside of the building 202 and excludes values of the received signal strength 130 associated with the wireless device 208 being outside of the building 202, which assists with decreasing false alarms.

As the user 210 sets the system to an intruder detection mode, the analytics module 114 cooperates with the sniffer 136 to look for values of received signal strength that match the profile 132. In other words, when the analytics module 114 determines that a wireless device 208 is likely inside the building 202, according to the profile 132 and based on the received signal strength 130, this is a possible intrusion event. For example, a received signal strength 130 that is within a range of received signal strength 130 as observed when the wireless device 208 was moved at random in the building 202, and which is not in the range of received signal strength 130 as observed when the wireless device 208 was moved at random outside the building 202, can be considered to meet the profile 132. The possible intrusion event should then be corroborated as to whether the media access control address is an addres that has been registered in the whitelist 118, as described below with reference to FIG. 2C. A wireless device 208 with a received signal strength 130 consistent with the wireless device 208 being inside the building 202 and with an accepted media access control address is not indicative of an intruder. A wireless device 208 with a received signal strength 130 inconsistent with the wireless device 208 being inside the building 202 is also not indicative of an intruder, regardless of media access control address. A wireless device 208 with a received signal strength 130 consistent with the wireless device 208 being inside of the same building 202 as the sniffer 136 and with a media access control address that has not been accepted is indicative of a possible intruder.

Figure 2C:
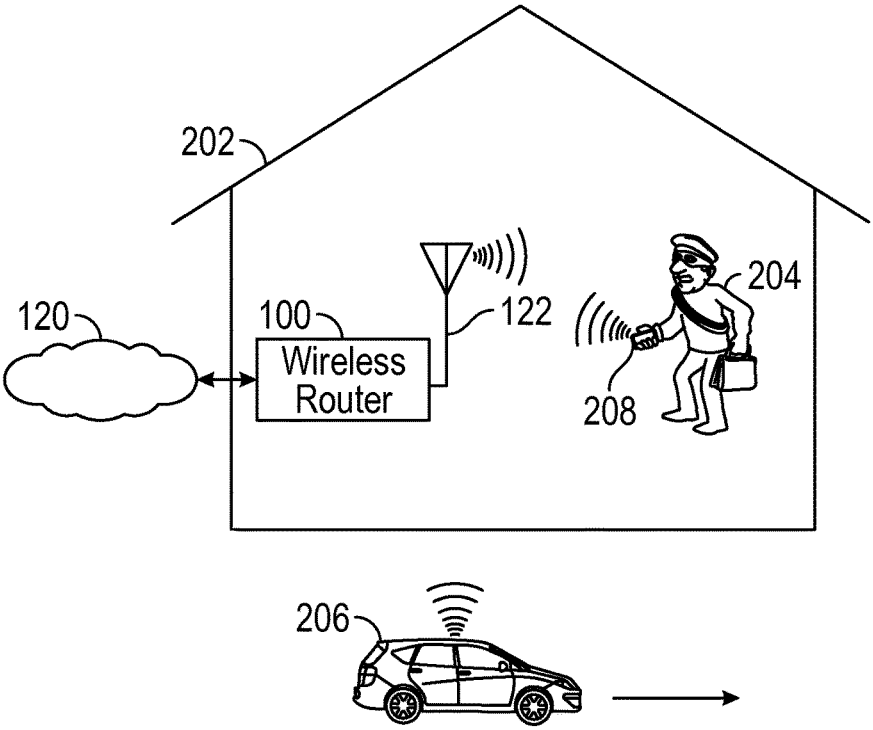
FIG. 2C is a scenario diagram, showing the wireless router of FIG. 1 detecting an intruder with a wireless device in a house or business in accordance with some embodiments.

FIG. 2C is a scenario diagram, showing the wireless router 100 of FIG. 1 detecting an intruder 204 with a wireless device 208 in a house or business, or other locale, e.g., a building 202 housing the wireless router 100. A distinction is herein made between detecting a physical intruder 204, versus detecting an electronic intruder such as a hacker, which can be addressed by other systems. Here, the wireless router 100 is operating in a monitoring mode, passively listening to wireless traffic such as Wi-Fi traffic based on Institute of Electrical and Electronics Engineers' (IEEE) 802.11 standards. The wireless router 100 can receive Wi-Fi packets in this mode, and determine media access control addresses of devices in the vicinity, i.e., within the detection zone of the wireless router 100. In this manner, the wireless router 100 can determine the media access control address of a wireless device 208 of the intruder 204 (provided, of course, that the wireless device 208 is active, functioning properly, and has a media access control address). The specially configured wireless router 100 could then compare the media access control address of the wireless device 208 to the whitelist 118. If the media access control address of the wireless device 208 is not found on the whitelist 118, i.e., is absent from the whitelist 118, the wireless router 100, more particularly the alert module 106, could send a notification out on the network 120, e.g., via the network module 104 of the wireless router 100. In the embodiment of FIG. 2C the sniffer is integrated into wireless router 100.

Referring to FIGS. 1 and 2C, the wireless router 100, and more specifically the analytics module 114, can develop the whitelist 118 during a learn mode or training mode over a specified span of time. If there is a false alarm, such as when a wireless device 208 has a media access control address not found in the whitelist 118 but a user later indicates this is a false alarm, the analytics module 114 can update or modify the whitelist 118 with the new learning. For example, a user could receive a notification to a cell phone, and send back a command or message that this is a false alarm, as the user recalls that relatives or friends are visiting. Alternatively, the user could review a history, and indicate that certain events are false alarms, e.g., via a graphical user interface (GUI). As explained further below, the wireless router 100 could monitor media access control addresses of wireless devices when not in training mode and not in intruder detection mode, and learn about various events and patterns of activity such as the automobile 206 (with a driver or passenger using a wireless device) driving by, people (carrying wireless devices) walking past the house, neighboring wireless devices, etc. In some embodiments, a user could invoke training mode, and the analytics module 114 can develop the whitelist 118 by adding media access control addresses of wireless devices detected during the training mode.

For example, the wireless router 100 can detect wireless devices of the homeowner, devices of guests, devices of neighbors, devices of people passing by, and a wireless device 208 of an intruder 204. Context information is applied to determine whether a detected device is a wireless device 208 of an intruder 204. The timer 126 can be applied when monitoring wireless devices, so that wireless devices of a passerby, which are present on the network for less than a specified time span, e.g., one minute, could be excluded from triggering an alarm. Wireless devices of an owner are whitelisted at initialization, e.g., during learn mode or training mode, in some embodiments. Wireless devices can be learned and whitelisted over time in some embodiments. For example, if an unknown wireless device and a known, whitelisted wireless device are present on the network at the same time, this could indicate that an owner and a friend or associate are present together, i.e., their devices are accompanying one another as a result of the mutual presence of the owners of the devices. Under such circumstances, the unknown device could be validated as a guest device, and the media access control address indicated as validated. If a validated wireless device is present for longer than a specified time span, e.g., if a wireless device of a neighbor and a wireless device of an owner are present for two or more hours, the validated device could be added to the whitelist 118. A presence pattern of whitelisted devices can be learned by the analytics module 114 in order to improve detection accuracy in some embodiments. For example, the analytics module 114 could infer that an owner is asleep between 12 AM and 7 AM because the specified wireless device of the owner is idle and has no activity during such time. Once an idle time is determined in a presence pattern, the analytics module 114 could declare that the system is in intruder detection mode during a subsequent idle time, and monitor for unknown wireless devices, triggering an alarm if an intrusion is detected. In some embodiments, the presence patterns and any of the learning associated with the modules of wireless router 100 may be stored in memory 116 or some external memory coupled to the wireless router for subsequent use.

Figure 3:
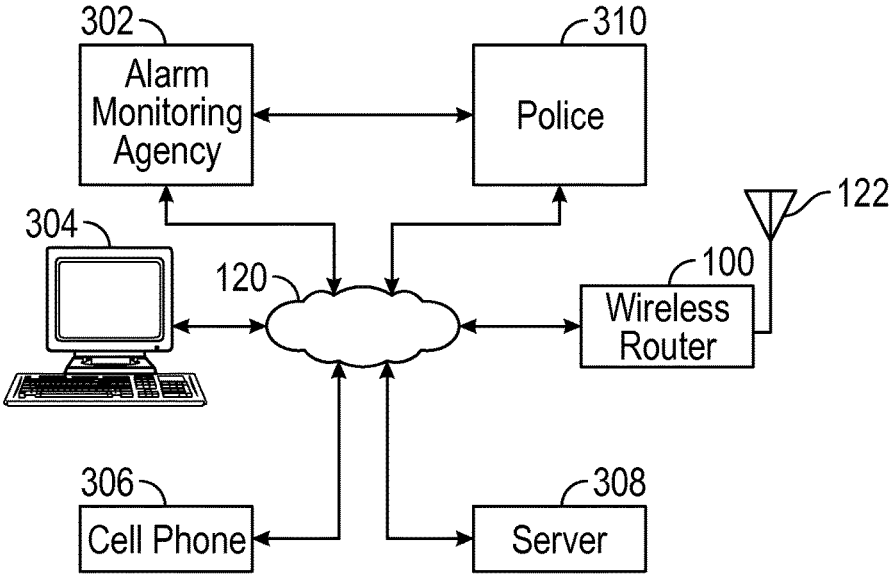
FIG. 3 is a system diagram, showing the wireless router of FIG. 1 coupled to a network and various devices in accordance with some embodiments.

FIG. 3 is a system diagram, showing the wireless router 100 of FIG. 1 coupled to a network 120 and various devices 304, 306, and 308. As discussed above, the wireless router 100, and more specifically the alert module 106, could send a notification via the network module 104 to the network 120. The notification could have an address of a server 308, so that the notification can be posted on the server 308. In some embodiments, the server 308 could act on receiving such a notification, and send a text message to a cell phone 306, an email to a computing device 304, a text message, a digitized or synthesized voice message, a document or other notification to an alarm monitoring agency 302 or the police 310, or otherwise send alerts or notifications. In some embodiments, the wireless router 100 can send such notifications directly to the cell phone 306, the computing device 304, the alarm monitoring agency 302 or police 310, or elsewhere. In some embodiments, a user could couple to the server 308, using a cell phone 306 via the network 120, in order to receive or check for an intruder alert per the notification from the alert module 106. For example, the alert module 106 could send a notification to the server 308, via the network 120. The server 308 could then send a text message via the network 120 to the cell phone 306. A user of the cell phone 306 could then couple via the network 120 to the server 308 to verify or obtain further details about the notification. In further examples, the server 308 or the wireless router 100 could broadcast the notification to multiple destinations. It should be appreciated that server 308 may be a backend server of the assignee in some embodiments.

Figure 4A:
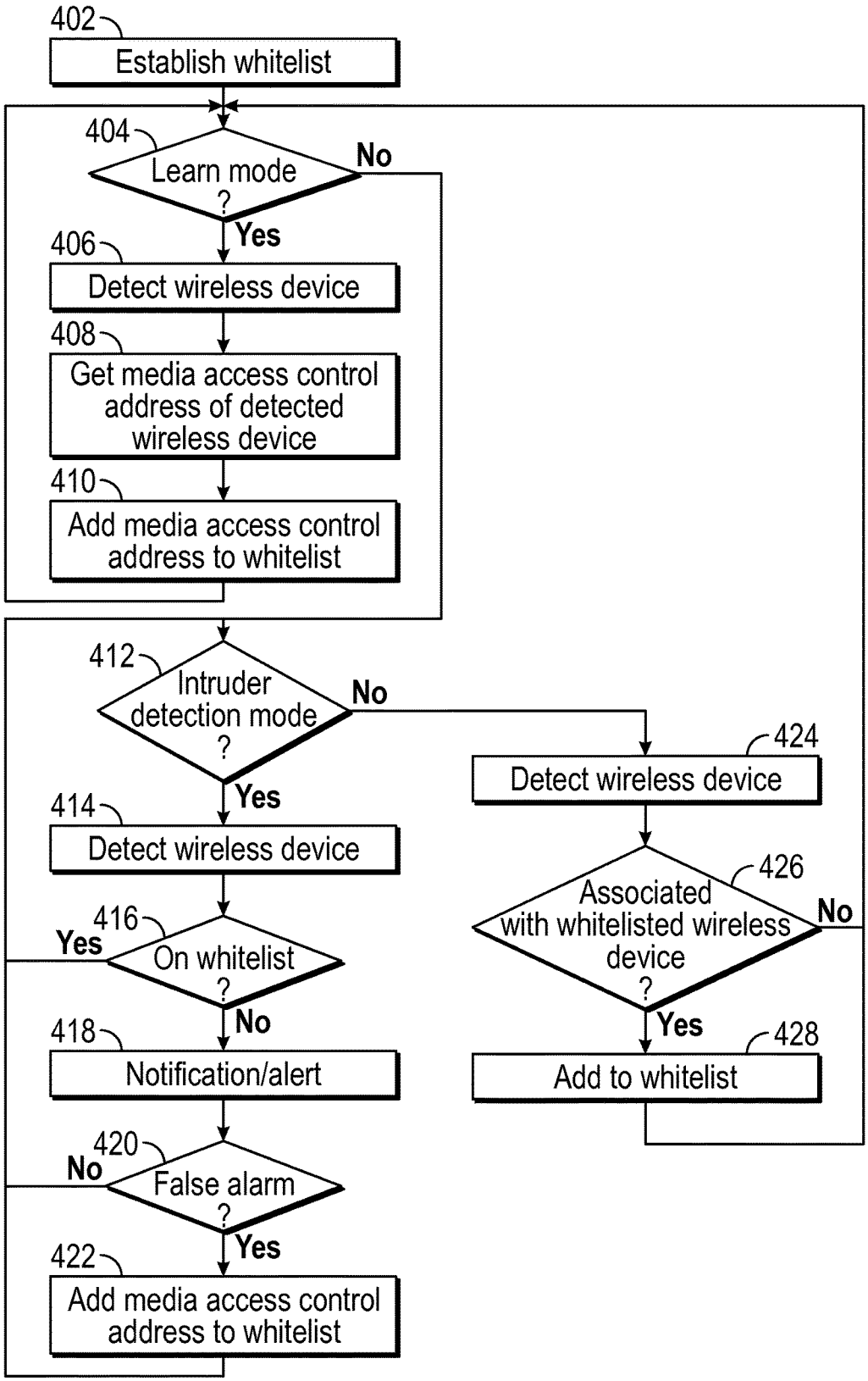
FIG. 4A is a flow diagram, showing a method of detecting an intruder as shown in FIG. 2C, which can be practiced on embodiments of the specially configured wireless router of FIG. 1 in accordance with some embodiments.

FIG. 4A is a flow diagram, showing a method of detecting an intruder, which can be practiced on embodiments of the specially configured wireless router 100 of FIG. 1. Many or all of the actions of the flow diagram in FIG. 4A can be performed by or using a processor, such as a processor in the wireless router 100 or a processor coupled to the wireless router 100. Variations and further embodiments of the depicted method are readily devised in accordance with the teachings disclosed herein. The method could be embodied on a tangible, non-transitory, computer-readable media. In an action 402, a whitelist is established. For example, the wireless router 100 could be shipped with a blank whitelist 118, which is later populated upon installation by a user. Or, the wireless router 100 could establish and populate the whitelist 118 upon power up or entry to training mode.

In a decision action 404 of FIG. 4A, it is determined if the system is in learn mode. If the system is not in learn mode, flow branches to the decision action 412. If the system is in learn mode, flow branches to the action 406. In an action 406, the system detects a wireless device. For example, the owner of the wireless router or the house or business could activate a Wi-Fi (wireless fidelity) equipped cell phone, laptop or other wireless device, within a detection zone of the wireless router, and the wireless router could detect this. In an action 408, the system gets the media access control address of the detected wireless device. For example, the media access control address monitor could obtain the media access control address of the detected wireless device from the wireless communication module, and pass this to the analytics module. It should be appreciated that each device is assigned a unique media access control address. A media access control address (MAC address) is a unique identifier assigned to network interfaces for communications on the physical network segment. MAC addresses are used as a network address for most network technologies, including Ethernet. Logically, MAC addresses are used in the media access control protocol sub-layer of the Open System Interconnection (OSI) reference model.

Still referring to FIG. 4A, in an action 410, the media access control address is added to the whitelist, as the system learns accepted devices and populates the whitelist with the media access control addresses of these devices. Flow branches back to the decision action 404, to determine if learn mode is still in effect. If learn mode is not active or enabled, the decision action 412 poses the question, is the system in intruder detection mode? If the answer is no, flow branches to the action 424. If the answer is yes, flow branches to the action 414. In the action 414, a wireless device is detected, with the system in intruder detection mode. For example, this could be the detection of a wireless device of an intruder, or a known, accepted wireless device.

In a decision action 416, a question is asked, is the detected wireless device on the whitelist? If the answer is no, flow branches to the action 418. If the answer is yes, flow branches back to the decision action 412, to determine if the system is still in intruder detection mode. In an action 418, a notification or alert is issued. This is in response to the system detecting a wireless device, during intruder detection mode, which device is not on the whitelist. The notification or alert could take any of the forms discussed above, such as posting to a server, sending a text message to a cell phone, contacting an agency and so on. In a decision action 420, a question is asked, is this a false alarm? If the answer is yes, flow continues to the action 422. If the answer is no, flow branches back to the decision action 412, to determine if the system is still in intruder detection mode and continues as described above.

In the action 422 of FIG. 4A, the media access control address of the wireless device detected during intruder detection mode is added to the whitelist. This is in response to such an address belonging to a device that was the subject of a false alarm. The whitelist is thus updated for improved accuracy. After the action 422, flow returns to the decision action 412, to determine if the system is still in intruder detection mode. In the action 424, which is arrived at if the system is not in intruder detection mode and not in learn mode, a wireless device is detected. In a decision action 426, a question is asked, is the detected wireless device associated with a whitelisted wireless device? For example, the detected wireless device and a wireless device that is whitelisted could be detected contemporaneously or within a specified time span. If the answer is no, flow branches back to the decision action 404, to determine if the system is in learn mode. If the answer is yes, flow branches to the action 428. In the action 428, the media access control address of the detected wireless device is added to the whitelist. This updates the whitelist for improved accuracy, so that the wireless device associated with the earlier whitelisted wireless device will not be identified as belonging to an intruder. After the action 428, flow branches to the decision action 404, to determine if the system is in learn mode and continues as described above. Variations of the above method and flow are readily devised in accordance with the teachings disclosed herein. For example, the flow could have various other branches, or a start point or endpoint, updates could be arranged at other times or places within a flow, and variations to the flow or further details to the flow could be added.

Figure 4B:
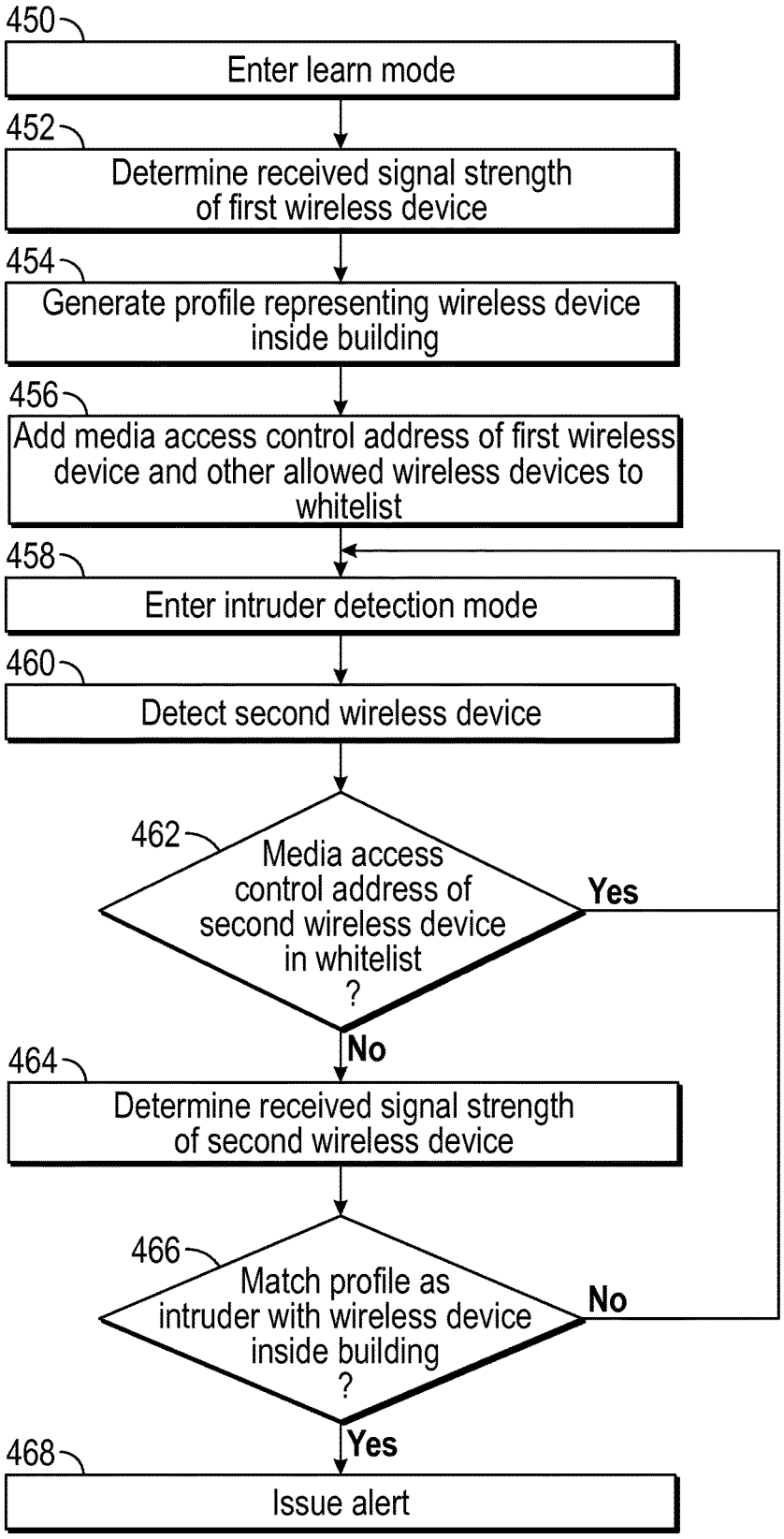
FIG. 4B is a flow diagram, showing a further method of detecting an intruder, employing automatic learning of signal strengths of a wireless device as shown in FIGS. 2A and 2B.

FIG. 4B is a flow diagram, showing a further method of detecting an intruder, employing automatic learning of signal strengths of a wireless device as shown in FIGS. 2A and 2B. The method can be practiced on or by a processor, such as a processor coupled to or in various embodiments of the wireless router and the sniffer described herein. In an action 450, the intruder detection system enters a learn mode. This could be invoked by user input, or could be a default mode initially or when the system is not in intruder detection mode. Received signal strength of a first wireless device is determined, in an action 452. This can occur while a user, with the first wireless device, moves at random inside the same building that has the wireless sniffer. A profile is generated, in an action 454. The profile represents the received signal strength of the wireless device inside the building. Development of the profile can be performed by the analytics module operating as described in the scenario shown in FIGS. 2A and 2B.

Continuing with FIG. 4B, the media access control address of the first wireless device is added to a whitelist, in an action 456. Any other allowed wireless devices should have respective media access control addresses added to the whitelist. The whitelist can be stored in memory in the wireless router, or in a computing device coupled to the wireless router or the sniffer, in various embodiments. Intruder detection mode is entered, in an action 458. This could be invoked by user input, either local to the wireless router or the sniffer, or remote, e.g., via a command sent over a network, etc. In intruder detection mode, the system looks for any wireless device that comes within detection range. A second wireless device is detected, in an action 460. In a decision action 462, it is determined whether the media access control address of the second wireless device is in the whitelist. If the answer is yes, this is characterized as not an intruder, and the flow branches back to the action 458 in order to reenter intruder detection mode and look for further wireless devices. If the answer is no, this is possibly an intruder, and the flow proceeds to the action 464.

In the action 464, the received signal strength of the second wireless device is determined. In a decision action 466, it is determined whether the received signal strength of the second wireless device matches the profile, as indicating an intruder with a wireless device is inside the building as discussed above with reference to FIG. 2B. If the answer is no, there is likely not an intruder inside the building and flow branches back to the action 458, in order to reenter intruder detection mode and continue looking for a wireless device with a media access control address that is not on the whitelist and which is inside the building. If the answer is yes, there is likely an intruder inside the building and flow proceeds to the action 468 to issue an alert. The alert could be in the form of activating an audio alarm or a visual signal, or sending a message over a network, or various other forms as readily devised. In variations of the above method, there could be other reentry points for either of the decision actions 462, 466, or the decision actions 462, 466 could be reversed in sequence or performed at other times in the flow, etc. Further variations are readily devised, in keeping with the teachings herein. An indication of a false alarm could be applied to update the profile and/or the whitelist as appropriate to the type of false alarm.

Figure 5:
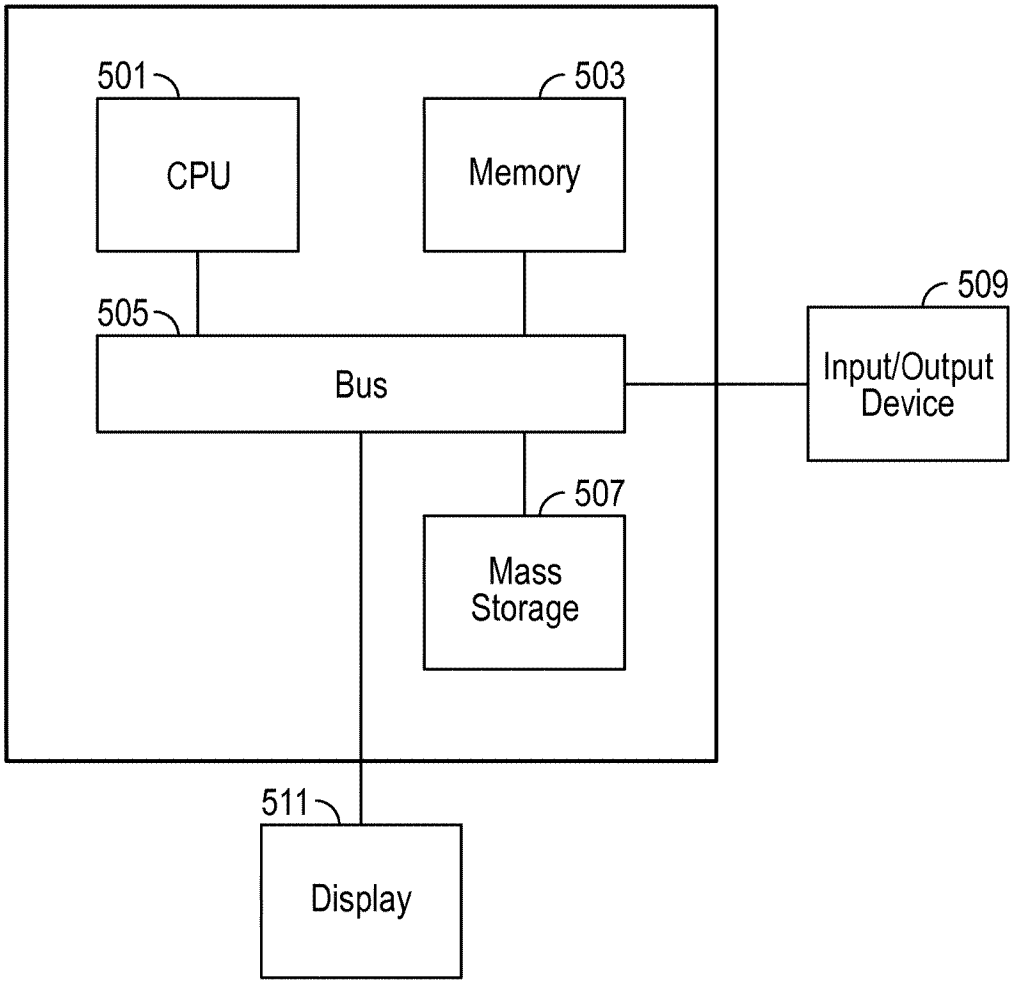
FIG. 5 is an illustration showing an exemplary computing device which may implement the embodiments described herein.

It should be appreciated that the methods described herein may be performed with a digital processing system, such as a conventional, general-purpose computer system. Special purpose computers, which are designed or programmed to perform only one function may be used in the alternative. FIG. 5 is an illustration showing an exemplary computing device which may implement the embodiments described herein. The computing device of FIG. 5 may be used to perform embodiments of the functionality for monitoring and analysis of received signal strength and media access control addresses in accordance with some embodiments. The computing device includes a central processing unit (CPU) 501, which is coupled through a bus 505 to a memory 503, and mass storage device 507. Mass storage device 507 represents a persistent data storage device such as a floppy disc drive or a fixed disc drive, which may be local or remote in some embodiments. The mass storage device 507 could implement a backup storage, in some embodiments. Memory 503 may include read only memory, random access memory, etc. Applications resident on the computing device may be stored on or accessed via a computer readable medium such as memory 503 or mass storage device 507 in some embodiments. Applications may also be in the form of modulated electronic signals modulated accessed via a network modem or other network interface of the computing device. It should be appreciated that CPU 501 may be embodied in a general-purpose processor, a special purpose processor, or a specially programmed logic device in some embodiments.

Display 511 is in communication with CPU 501, memory 503, and mass storage device 507, through bus 505. Display 511 is configured to display any visualization tools or reports associated with the system described herein. Input/output device 509 is coupled to bus 505 in order to communicate information in command selections to CPU 501. It should be appreciated that data to and from external devices may be communicated through the input/output device 509. CPU 501 can be defined to execute the functionality described herein to enable the functionality described with reference to FIGS. 1-4. The code embodying this functionality may be stored within memory 503 or mass storage device 507 for execution by a processor such as CPU 501 in some embodiments. The operating system on the computing device may be MS-WINDOWS™, UNIX™, LINUX™, iOS™, or other known operating systems. It should be appreciated that the embodiments described herein may be integrated with virtualized computing system also.

Detailed illustrative embodiments are disclosed herein. However, specific functional details disclosed herein are merely representative for purposes of describing embodiments. Embodiments may, however, be embodied in many alternate forms and should not be construed as limited to only the embodiments set forth herein. In addition, the embodiments described herein may be stand-alone products or may be integrated into software and/or hardware products of the assignee.

It should be understood that although the terms first, second, etc. may be used herein to describe various steps or calculations, these steps or calculations should not be limited by these terms. These terms are only used to distinguish one step or calculation from another. For example, a first calculation could be termed a second calculation, and, similarly, a second step could be termed a first step, without departing from the scope of this disclosure. As used herein, the term "and/or" and the "/" symbol includes any and all combinations of one or more of the associated listed items.

As used herein, the singular forms "a", "an" and "the" are intended to include the plural forms as well, unless the context clearly indicates otherwise. It will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof. Therefore, the terminology used herein is for the purpose of describing particular embodiments only and is not intended to be limiting.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

With the above embodiments in mind, it should be understood that the embodiments might employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing. Any of the operations described herein that form part of the embodiments are useful machine operations. The embodiments also relate to a device or an apparatus for performing these operations. The apparatus can be specially constructed for the required purpose, or the apparatus can be a general-purpose computer selectively activated or configured by a computer program stored in the computer. In particular, various general-purpose machines can be used with computer programs written in accordance with the teachings herein, or it may be more convenient to construct a more specialized apparatus to perform the required operations.

A module, an application, a layer, an agent or other method-operable entity could be implemented as hardware, firmware, or a processor executing software, or combinations thereof. It should be appreciated that, where a software-based embodiment is disclosed herein, the software can be embodied in a physical machine such as a controller. For example, a controller could include a first module and a second module. A controller could be configured to perform various actions, e.g., of a method, an application, a layer or an agent.

The embodiments can also be embodied as computer readable code on a computer readable medium. The computer readable medium is any data storage device that can store data, which can be thereafter read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer system so that the computer readable code is stored and executed in a distributed fashion. Embodiments described herein may be practiced with various computer system configurations including hand-held devices, tablets, microprocessor systems, microprocessor-based or programmable consumer electronics, minicomputers, mainframe computers and the like. The embodiments can also be practiced in distributed computing environments where tasks are performed by remote processing devices that are linked through a wire-based or wireless network.

Although the method operations were described in a specific order, it should be understood that other operations may be performed in between described operations, described operations may be adjusted so that they occur at slightly different times or the described operations may be distributed in a system which allows the occurrence of the processing operations at various intervals associated with the processing.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the embodiments and its practical applications, to thereby enable others skilled in the art to best utilize the embodiments and various modifications as may be suited to the particular use contemplated. Accordingly, the present embodiments are to be considered as illustrative and not restrictive, and the invention is not to be limited to the details given herein, but may be modified within the scope and equivalents of the appended claims.

What is claimed is:

1. A method for intruder detection performed by a processor, comprising:

determining received signal strength of a first wireless device, while the first wireless device is moved at random within a region;

generating a profile of the received signal strength of the first wireless device;

determining received signal strength of a second wireless device;

determining received signal strength of the first wireless device, while the first wireless device is moved at random outside the region; and adding information, regarding the received signal strength of the first wireless device while the first wireless device is moved at random outside the region, to the profile; and issuing an alert, responsive to received signal strength of the second wireless device meeting the profile, wherein a processor performs at least one action of the method.

2. The method of claim 1, further comprising:

determining a plurality of stable values of the received signal strength of the first wireless device, each of the plurality of stable values based on the received signal strength of the first wireless device being maintained within a predetermined variability for a predetermined time span while the first wireless device is moved at random in the region, wherein the profile includes a minimum one of the plurality of stable values and a maximum one of the plurality of stable values.

3. The method of claim 1, wherein:

the determining the received signal strength of the first wireless device occurs during a learn mode; and the determining the received signal strength of the second wireless device occurs during an intruder detection mode.

4. The method of claim 1, wherein a systematic training regimen involving a plurality of specific locations of the first wireless device inside the region is avoided.

5. The method of claim 1, wherein meeting the profile includes the received signal strength of the second wireless device being within a range of the received signal strength of the first wireless device as observed while the first wireless device is moved at random in the region and excludes the received signal strength of the second wireless device being within a range of the received signal strength of the first wireless device as observed while the first wireless device is moved at random outside the region.

6. The method of claim 1, wherein issuing the alert includes sending the alert to one of a server, a user device, an agency or an authority.

7. The method of claim 1, wherein meeting the profile comprises the received signal strength of the second wireless device being maintained within a predetermined variability for a predetermined time span at a stable value that matches a stable value in the profile.

8. A tangible, non-transitory, computer-readable media having instructions thereupon which, when executed by a processor, cause the processor to perform a method comprising:

analyzing received signal strength of a first wireless device, as observed by a wireless sniffer during random motion of the first wireless device within a region;

determining a profile of the received signal strength of the first wireless device, based on the analyzing;

determining whether received signal strength of a second wireless device, as observed by the wireless sniffer, matches the profile;

indicating an intruder detection, based at least in part on a determination that the received signal strength of the second wireless device matches the profile;

further analyzing received signal strength of the first wireless device, as observed by the wireless sniffer during random motion of the first wireless device outside the region; and modifying the profile, based on the further analyzing, so that the profile represents the received signal strength of the first wireless device inside the region and excludes the received signal strength of the first wireless device outside the region.

9. The computer-readable media of claim 8, wherein the method further comprises:

determining a minimum stable value of the received signal strength of the first wireless device; and determining a maximum stable value of the received signal strength of the first wireless device, wherein generating the profile includes saving the minimum stable value and the maximum stable value in the profile.

10. The computer-readable media of claim 8, wherein the method further comprises:

storing a media access control (MAC) address of the first wireless device in a whitelist; and determining whether a MAC address of the second wireless device is in the whitelist, wherein indicating the intruder detection is further responsive to the MAC address of the second wireless device being absent from the whitelist.

11. The computer-readable media of claim 8, wherein determining whether the received signal strength of the second wireless device matches the profile comprises:

determining whether the received signal strength of the second wireless device attains a stable value for a predetermined time span, with the stable value matching a stable value of the received signal strength of the first wireless device being in the region, as represented in the profile.

12. The computer-readable media of claim 8, wherein indicating the intruder detection comprises sending a message via a network.

13. An intruder detection system, comprising:

a wireless sniffer, configured to detect wireless devices and determine received signal strength thereof;

a memory, configured to store a profile;

an alert module configured to issue an alert in response to being triggered; and an analytics module, configured to generate the profile based on analysis of received signal strength of a first wireless device moved at random within a region in which the wireless sniffer is located, and configured to perform comparison of received signal strength of a second wireless device to the profile and trigger the alert module based at least in part on the comparison, the analytics module configured to store information in the profile, based on analysis of received signal strength of the second wireless device moved at random external to the region.

14. The intruder detection system of claim 13, further comprising:

the analytics module configured to determine a plurality of stable values of the received signal strength of the first wireless device and configured to store a minimum stable value and a maximum stable value, of the plurality of stable values, in the profile.

15. The intruder detection system of claim 13, further comprising:

the analytics module configured to enter an intruder detection mode, wherein the profile is generated outside of the intruder detection mode and the alert can be triggered in the intruder detection mode.

16. The intruder detection system of claim 13, further comprising:

a media access control (MAC) address monitor, configured to obtain media access control addresses of the wireless devices; and the analytics module configured to add a MAC address of the first wireless device to a whitelist in the memory, and configured to determine whether a MAC address of the second wireless device is present in the whitelist, wherein the analytics module triggering the alert module is responsive to a determination that the MAC address of the second wireless device is not present in the whitelist and a determination that the received signal strength of the second wireless device indicates the second wireless device is in the region, according to the profile.

17. The intruder detection system of claim 13, further comprising:

the analytics module configured to analyze the received signal strength of the second wireless device as to stability within a predetermined range that matches a stable value in the profile.

18. The intruder detection system of claim 13, wherein the wireless sniffer resides at least partially in a wireless router.

* * * * *